US011421874B2

(12) United States Patent
Cowan et al.

(10) Patent No.: US 11,421,874 B2
(45) Date of Patent: Aug. 23, 2022

(54) DIGITAL GAS VALVE BURNER CONTROL SYSTEMS AND METHODS

(71) Applicant: Midea Group Co., Ltd., Foshan (CN)

(72) Inventors: Richard W. Cowan, Louisville, KY (US); Daniel J. Trice, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 689 days.

(21) Appl. No.: 16/358,293

(22) Filed: Mar. 19, 2019

(65) Prior Publication Data

US 2020/0300507 A1 Sep. 24, 2020

(51) Int. Cl.

| | |
|---|---|
| ***F23N 1/00*** | (2006.01) |
| ***F23N 5/20*** | (2006.01) |
| ***F24C 3/02*** | (2021.01) |
| ***F24H 9/20*** | (2022.01) |

(52) U.S. Cl.

CPC ..... *F23N 1/005* (2013.01); *F23N 1/002* (2013.01); *F23N 5/206* (2013.01); *F24C 3/02* (2013.01); *F24H 9/2035* (2013.01); *F23N 2235/14* (2020.01); *F23N 2237/00* (2020.01); *F23N 2241/04* (2020.01); *F23N 2241/08* (2020.01)

(58) Field of Classification Search

CPC ..... F24C 3/02

See application file for complete search history.

(56) References Cited

U.S. PATENT DOCUMENTS

| | | | | |
|---|---|---|---|---|
| 4,671,457 | A * | 6/1987 | Berkhof | G05D 23/1913 236/46 R |
| 5,234,196 | A | 8/1993 | Harris | |
| 5,333,596 | A | 8/1994 | Clifford | |
| 5,575,638 | A * | 11/1996 | Witham | F24C 3/126 431/73 |
| 5,596,514 | A * | 1/1997 | Maher | G05D 23/1917 700/306 |
| 5,810,576 | A | 9/1998 | Franchi et al. | |
| 5,924,857 | A | 7/1999 | Frasnetti et al. | |
| 6,376,817 | B1 | 4/2002 | McFadden et al. | |
| 6,619,951 | B2 | 9/2003 | Bodnar et al. | |
| 6,881,055 | B2 | 4/2005 | Bird | |

(Continued)

FOREIGN PATENT DOCUMENTS

| | | |
|---|---|---|
| CN | 102734849 A | 10/2012 |
| CN | 103836642 A | 6/2014 |

(Continued)

OTHER PUBLICATIONS

Acosta, EP 2469172 A2—Translated, Jun. 2012 (Year: 2012).*

(Continued)

*Primary Examiner* — Michael G Hoang
*Assistant Examiner* — David Jung Hyon Cho
(74) *Attorney, Agent, or Firm* — Middleton Reutlinger

(57) ABSTRACT

A system for controlling digital gas valves of an appliance utilizing a configurable duty cycle that includes a configurable ON time, a configurable cycle period and one or more configurable burner power level variables. In some instances, the configurable duty cycle may be configured at least in part by operation of a control knob, and in some instances, multiple burner power levels may be specified such that cycling may be performed between multiple burner power levels.

10 Claims, 6 Drawing Sheets

(56) References Cited

U.S. PATENT DOCUMENTS

| | | | | |
|---|---|---|---|---|
| 7,241,135 | B2 | 7/2007 | Munsterhuis et al. | |
| 7,669,590 | B2 | 3/2010 | Oberhomburg | |
| 3,126,631 | A1 | 2/2012 | Scalia, Jr. | |
| 8,926,318 | B2 | 1/2015 | Barritt et al. | |
| 9,377,190 | B2 | 6/2016 | Karkow et al. | |
| 9,423,124 | B2 | 8/2016 | Barudi | |
| 2017/0299200 | A1 | 10/2017 | Mercier, Sr. | |
| 2018/0018027 | A1* | 1/2018 | Kowalk | G06F 3/0362 |
| 2018/0070756 | A1 | 3/2018 | Vengroff | |
| 2018/0372315 | A1 | 12/2018 | Thomas | |

FOREIGN PATENT DOCUMENTS

| | | | | |
|---|---|---|---|---|
| CN | 108506969 | A | 9/2018 | |
| DE | 102007008893 | A1 * | 8/2008 | F24C 7/08 |
| DE | 102014216773 | A1 | 2/2016 | |
| EP | 2469172 | A2 | 6/2012 | |
| JP | H02197720 | A | 8/1990 | |
| WO | WO2008147043 | A1 | 12/2008 | |

OTHER PUBLICATIONS

Erdmann, DE102007008893A1—Translated, Aug. 2008 (Year: 2008).*
Wolf Gourmet, Multi-Function Cooker (Year: 2017).*
Google Search for "multifunction control cooker" (Year: 2022).*
International Search Report and Written Opinion in Application No. PCT/CN2019/121278, dated Feb. 28, 2020.
Brahma S.p.A, NDM Control Systems, Brahma Components and Systems for Heating, Retrieved on Feb. 6, 2019.
Shaban, E.M. et al., Design, Simulation and Implementation of a Class of True Digital Control (TDC) Applied to Natural Gas Burner, IEE, Dec. 16, 2009.

* cited by examiner

DIGITAL GAS VALVE BURNER CONTROL SYSTEMS AND METHODS

BACKGROUND OF THE INVENTION

In appliance manufacturing industries generally, and specifically in the range or cooking appliance manufacturing industries, most appliances such as cooktops or ranges have a variety of control or selector knobs for adjusting and controlling the amount of heat supplied to the various appliance burners or heating elements. In many instances these knobs provide direct mechanical control over the opening and closing of the gas valve or valves required to provide gas to a burner, or a plurality thereof. However, in some modern cooking appliances, the gas valves are controlled electronically and thus can be physically separate from the control knobs or selectors. In these systems "digital" gas valves, meaning gas valves that accept an electrical control signal to operate, may be mounted remotely from the control selectors.

The control knobs or selectors used to control the gas supplied to a burner in a digital gas valve system have a "low" or minimum setting as well as a "high" or maximum setting and may be varied nearly infinitely between these two extremes. The low setting provides a minimum operating signal to a digital valve, whereupon the valve opens to a predetermined low-flow open position that is dependent upon the burner characteristics. However, when it may be useful to cook or heat at a temperature below that of the minimum burner operating profile, for example when cooking sauces or simmering at a low heat a user must turn the control selector on and then off again to further reduce the minimum heat supplied to the burner.

A gas burner, for example as a cooktop burner, is designed to function over a range of flow rates. Based on the burner design and gas used there is a maximum and minimum flow rate that any given burner can sustain. The ratio of maximum flow to minimum flow is called the turndown ratio. High quality cooktop burners achieve a turndown ratio of 10 to 1. This turndown ratio becomes an issue with some larger burners because the minimum flow is high. For example an 18,000 BTU/hr burner may have a minimum flow of 2000 BTU. However, when this minimum flow temperature may be quite high for a cooking application such as low-heat simmering. Therefore, there is a need in the art to improve the burner turndown ratio.

Furthermore, in oven applications where the oven is being heated to a temperature set point, it is often the case that the digital valve, which is being controlled through temperature feedback, is opened at a predetermined "high" setting until the oven reaches the set point, and then controlled to a closed position once that set point is attained. When the oven temperature drops a predetermined amount below the set point, the valve or valves are then opened again. Obviously this operation results in somewhat uneven heating for the oven contents since the temperature oscillates continuously.

Some prior art cooktops achieve low-heat burner operation by cycling burners off and on for fixed periods. For example, some prior art cooktop burners cycle a burner over a 60 second period, turning the burner on at a minimum flow rate for 7, 22, 37 or 52 seconds, and off for the remainder of the cycle. However, this type of operation does not offer any flexibility if these preselected options are unsuitable for a particular cooking application.

From the foregoing it can readily be seen that there is a need in the art for a digital gas valve control system that is capable of cycling the operation of the gas valve being controlled to accurately control the gas flow through the valve, and thus the temperature applied to the burner.

SUMMARY OF THE INVENTION

The present disclosure is related to systems and apparatus for an infinitely variable low flow gas valve adjustment, allowing a user to specify and customize the cycle period and the percentage of time that a valve or burner is on during the period. Additionally, the invention will enable a user to select a cycle period and vary the on percentage time infinitely with a control knob or selector. In other aspects and embodiments a user may discover and select desired control settings and save the combination in memory for future use.

Additionally, in some aspects and embodiments of the present invention the system described herein will have the capability to cycle between burner power levels, or equivalently gas valve position levels. In these embodiments a burner being controlled does not extinguish and reignite, it merely cycles between two preselected power levels or valve positions, e.g. minimum flow and a specified percentage flow. These embodiments have the additional benefit of reducing igniter wear, and avoiding the constant "click" of the igniter as it reignites the burner.

In yet further aspects and embodiments the system disclosed herein permits a user to cycle a selected burner on and off at its minimum flow rate based on a temperature feedback for the purpose of controlling the temperature of food being prepared. In these embodiments a selected burner can cycle off when a temperature sensor detects an upper limit and then cycle back on when it detects a lower limit. In various embodiments the temperature measurement device may be a wireless probe, a vision system, a contact sensor on the bottom of the pan, a pan/pot with integrated sensor, or a traditional thermocouple or resistive thermocouple device.

In yet further aspects and embodiments the invention can be utilized to control oven burners as well. In some embodiments the system permits cycling between a plurality of oven burner power levels to thermostatically control the temperature of the oven cavity, without extinguishing the oven burner or burners.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION OF THE INVENTION

Figure 1:
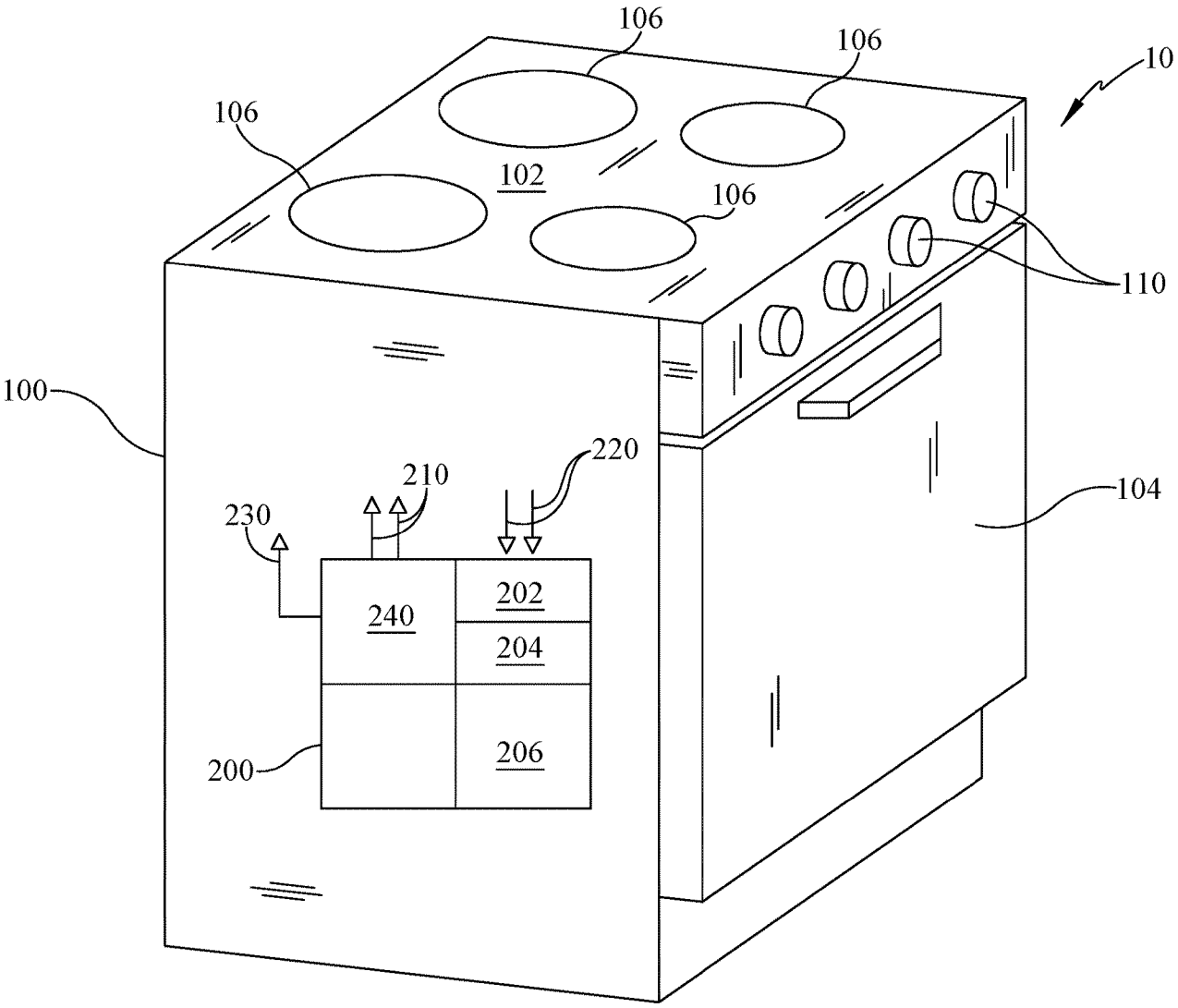
FIG. 1 is a block diagram of a control system that may be used in conjunction with an appliance in accordance with various embodiments.
Figure 2:
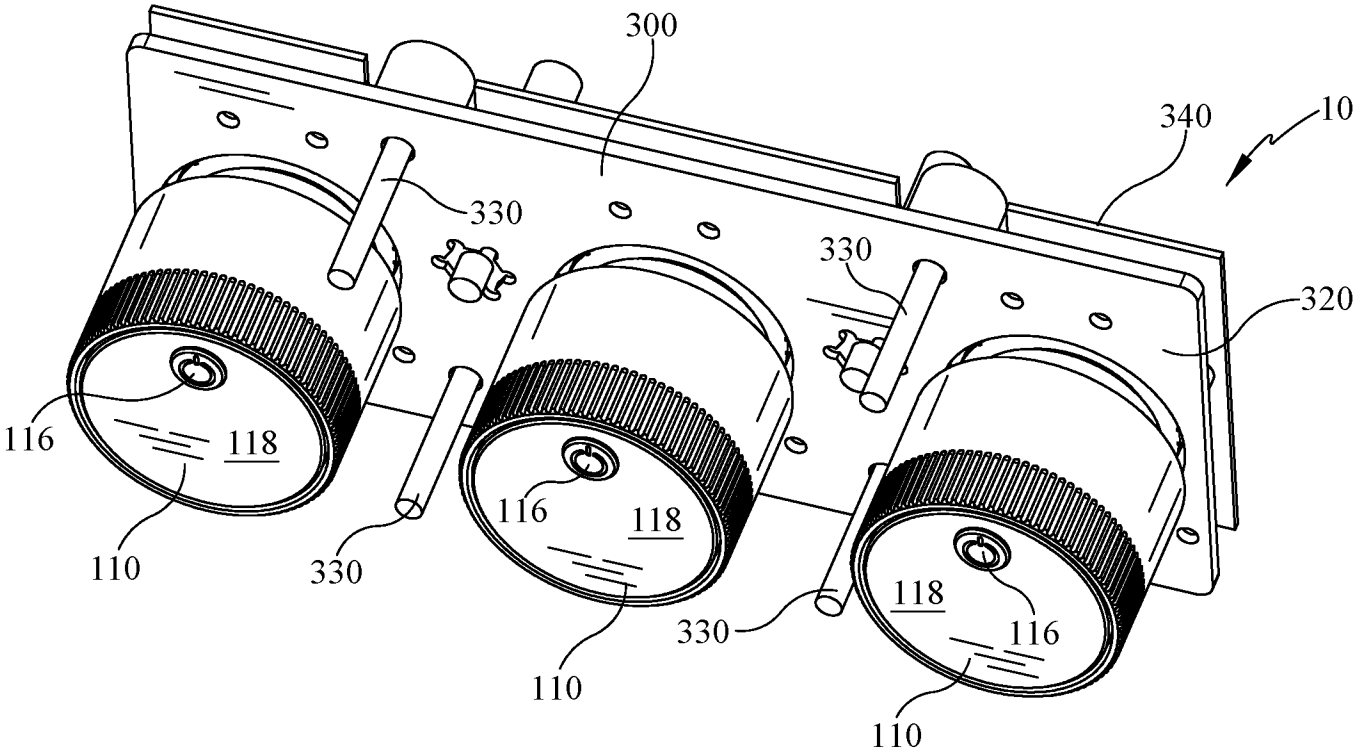
FIG. 2 is an exploded perspective view of an assembly of a plurality of control knobs of an appliance in accordance with various embodiments.
Figure 3:
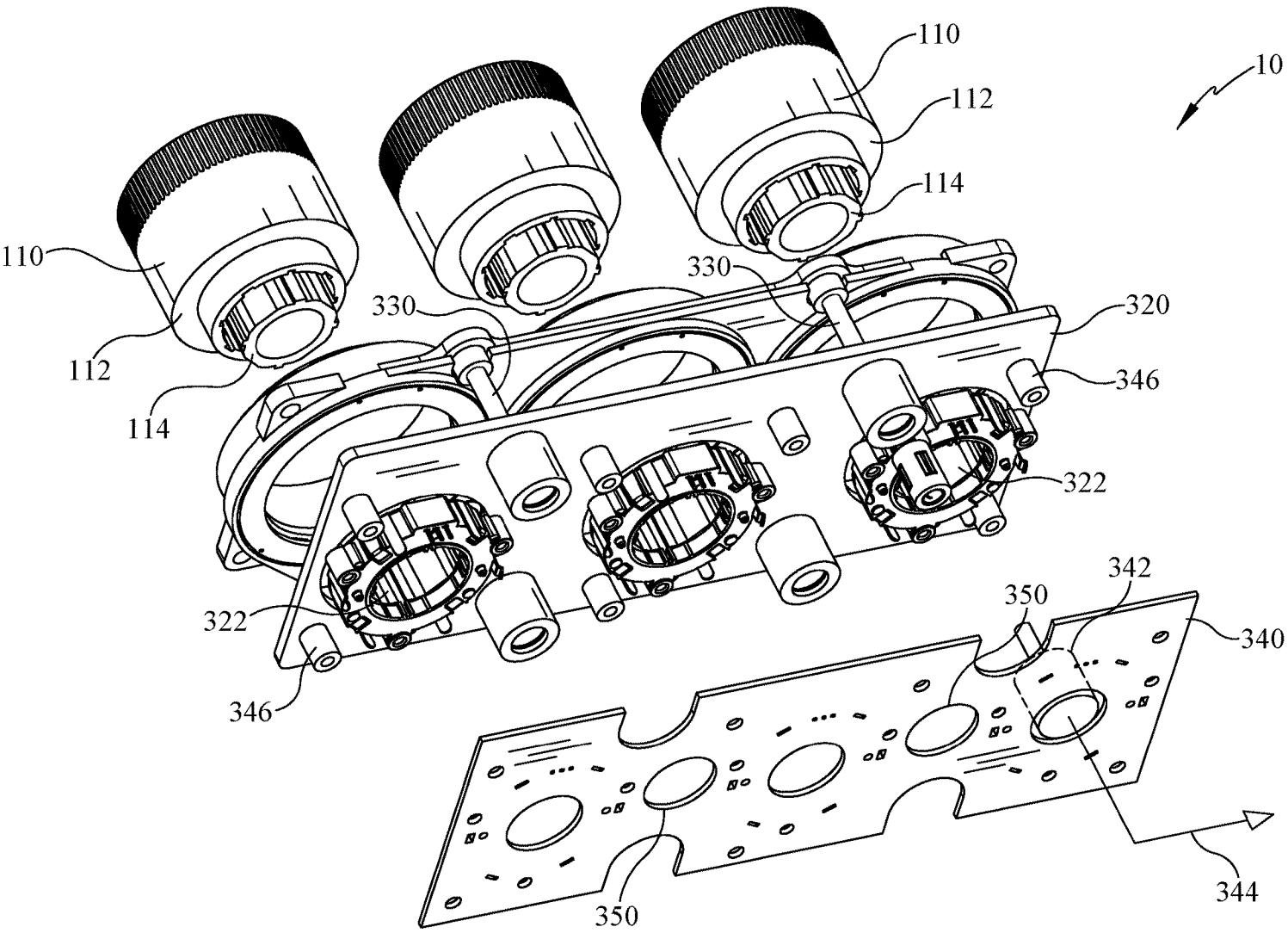
FIG. 3 is a perspective view of a retraction and extension assembly in accordance with some aspects and embodiments.

Referring to drawing FIGS. 1-3, and in accordance with various aspects and embodiments of the invention, a system 10 for retractable and extendable control knobs or selectors for an appliance 100 is described. In various embodiments the appliance 100 in which system 10 is implemented may include a controller 200 integral to appliance 100 that operates appliance 100 and implements various embodiments and aspects of system 10 as described herein. FIG. 1 illustrates an exemplary appliance 100 hardware environment for implementing system 10 for cycling schemes for digital gas valves. The system 10 may include a controller 200, a processor or processors 202 and concomitant memory 204. Appliance 100 may further comprise a plurality of signal outputs 210 and signal inputs 220 that may be operatively connected to a plurality of appliance 100 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator or user interface 240 to provide audible or visual feedback to a user as well as provide a user the ability to provide instructions or commands to controller 200. Exemplary but non-limiting user interfaces that may be employed include a mouse, keypads, touch-screens, keyboards, switches and/or touch pads or even wirelessly connected cell phones. Any user interface may be employed for use in the invention without departing from the scope thereof. It will be understood that FIG. 1 constitutes, in some respects, an abstraction and that the actual organization of the components of appliance 100 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 240 may include one or more devices for enabling communication with a user such as an administrator. For example, the user interface 240 may include a display, a mouse, and a keyboard for receiving user commands. In some embodiments, the user interface 240 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Referring now to FIGS. 1-4, and in accordance with some embodiments, a system 10 for controlling and cycling gas valves for an appliance 100 includes a plurality of control knobs 110 (alternatively selector knobs 110), that are utilized to operate appliance 100. It should be understood that any appliance 100 or other device that utilized control or selector knobs 110 wherein it would be desirable to control access thereto may be employed as a part of system 10 without departing from the scope of the invention.

In one non-limiting exemplary embodiment for purposes of illustration in this specification, appliance 100 may be a conventional stove 100, or equivalently a cooktop 102 and oven 104 combination. Stove 100 may include multiple control knobs 110, for example control knobs to adjust the function of a plurality of cooktop burners 106 as well as a plurality of oven heating elements or burners 106. Other control knobs 110 for adjusting or operating various appliance 100 controls may also be present, but for purposes of explication have been omitted from this example. In one exemplary but non-limiting embodiment that will be used throughout this specification for purposes of explication, the control knobs 110 may be assumed to operate a plurality of temperature controls, for example gas cooktop burners 106 and/or gas oven burners 106. In some embodiments, each control knob 110 may include an additional control disposed thereon, e.g., a button 116 disposed on a front surface 118 thereof.

As shown in FIGS. 2-5, and again using the example of a gas 1 control knobs 110, the plurality of control knobs 110 may be mounted to a support structure 300 that may in some embodiment include an encoder plate 320 having a plurality of knob mounting apertures 322 into which knobs 110 are positioned. Knobs 110 are typically two-piece knobs, having a rotatable outer portion 112 and a fixed inner portion 114 that is used to mount control knobs 110. Encoder plate 320 may include a plurality of guide rods 330 extending mounted at a plurality of points on plate 320 and extending outwardly toward control knobs 110. An encoder board 340 is provided, having a plurality of encoders 342 secured thereto for engaging rotatable outer portion 112 of control knobs 110. Encoder board 340 also includes a plurality of apertures 350.

Figure 4:
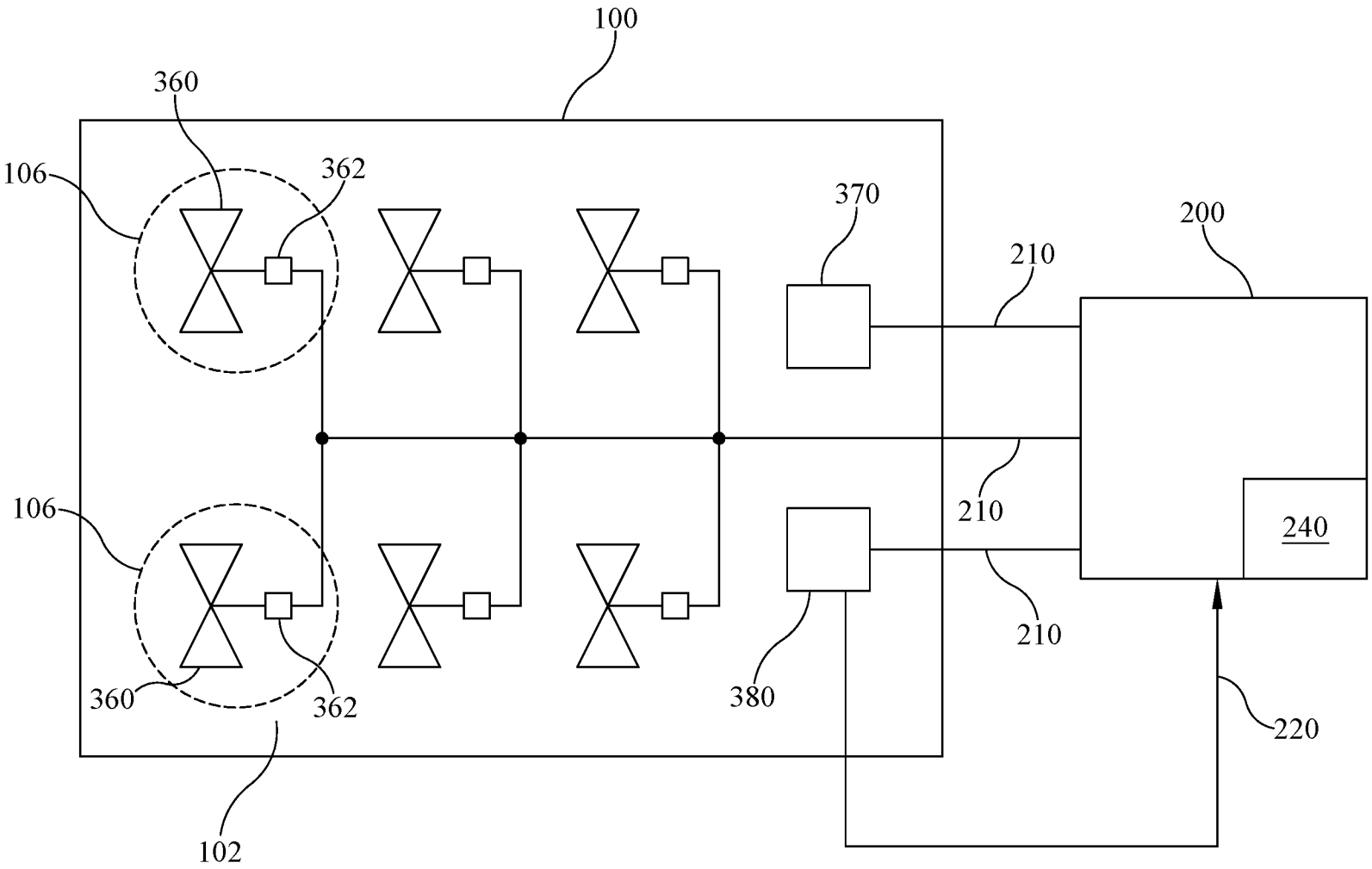
FIG. 4 is a schematic of a plurality of gas control valves and burners in accordance with some aspects and embodiments.

Encoder board 340 in some aspects and embodiments functions as a circuit board onto which a plurality of encoders 342 are soldered or otherwise electrically operatively mounted. Encoders 342 may each have an output 344 that is operatively coupled to a controller 200 input 220, that is representative of the amount of heat (or gas) to be supplied to the burner of appliance 100. Alternatively, encoder 342 output 344 may be representative of a gas valve 360 position or open percentage, thus effectively controlling the flow of gas 1 to a burner and ultimately the amount of heat supplied there through. In accordance with some embodiments the encoder 342 output 344 may be supplied directly to an electromechanical gas valve 360 for changing the gas valve 360 position. In another exemplary embodiment encoder board 340 may have a plurality of rotary potentiometers 342 secured thereto (in place of encoders) that engage rotatable outer portion 112 of control knobs 110. The encoders 342 (or rotary potentiometers) may each include an output 344 representative of a desired valve 360 position (or burner temperature) that is operatively coupled to an input 220 of controller 200. As best seen in FIGS. 2-4, encoder board 340, which may in some embodiments be a circuit board or circuit board substrate, may be secured to encoder plate 320 via a plurality of spacers 346.

Figure 5:
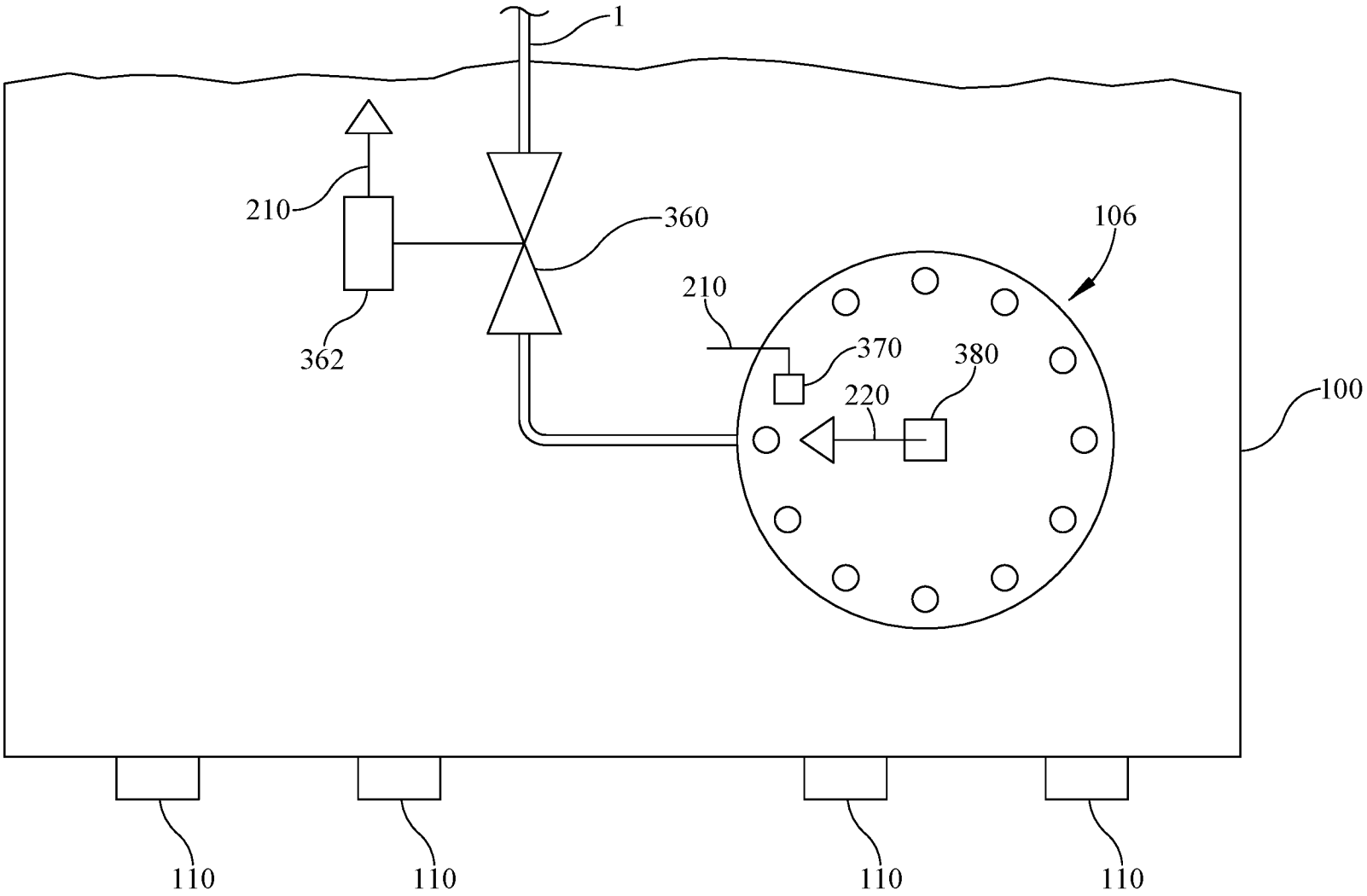
FIG. 5 is a schematic of a gas control valve and burner in accordance with some aspects and embodiments.

As best seen in FIGS. 4 and 5 and in accordance with some aspects of control system 10 gas valves 360 may be arranged on a cooktop 102, or alternatively in an oven. Each valve 360 may in some embodiments include an actuator 362 that accepts an output 210 from controller 200 representative of valve 360 position. Each valve 360 thus supplies gas 1 to a burner 106, or a plurality thereof. Additionally, each burner 106 may include an igniter 370 for igniting burner 106 that is actuated by an output 210 from processor 202. A plurality of temperature sensors 380 may also be provided for burners 106 to provide a signal input 220 to processor 202 representative of a burner 106 temperature.

Figure 6:
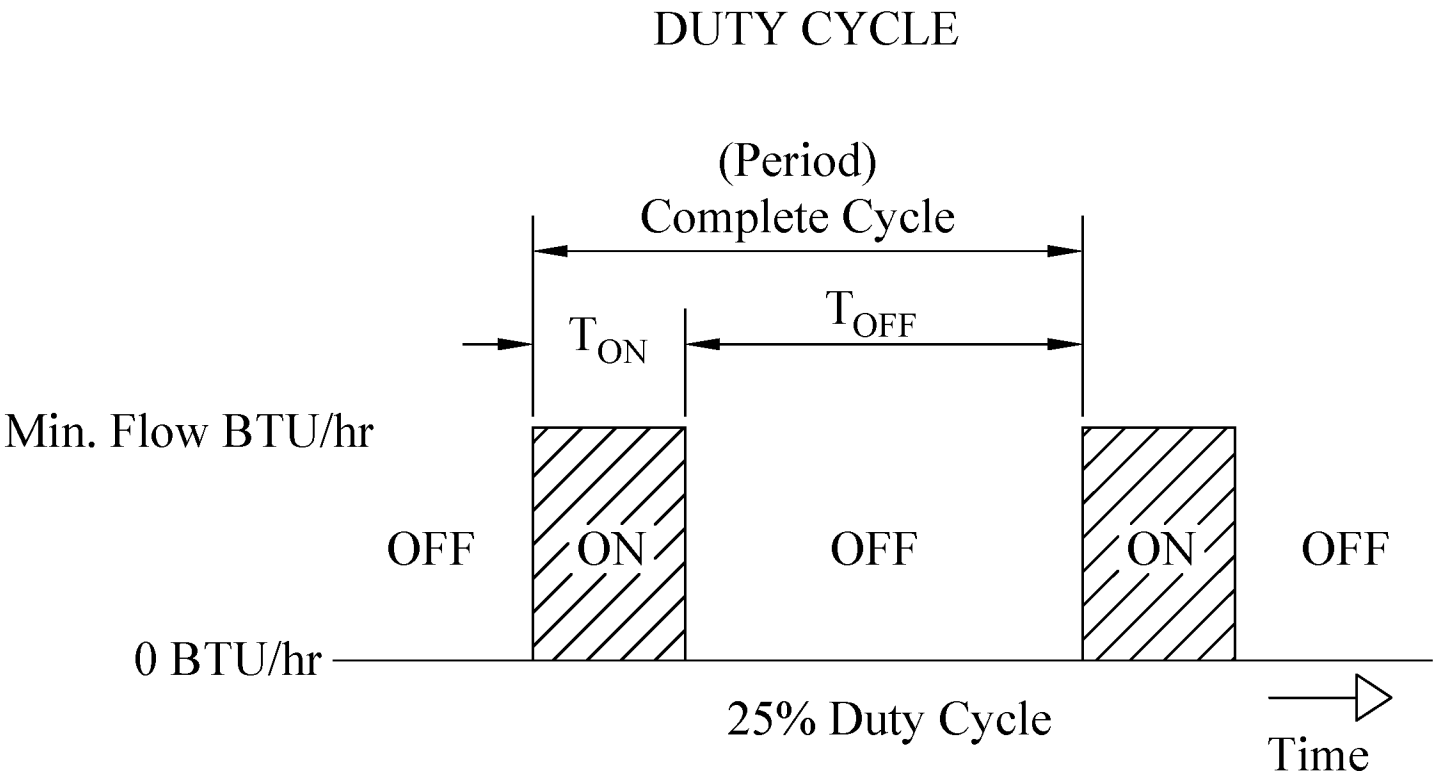
FIG. 6 is duty cycle chart in accordance with some aspects and embodiments.

Referring again to FIGS. 4-6, and in accordance with various embodiments, system 10 permits a user to select, modify and save a duty cycle for a specific burner 106 and/or gas valve 360. Using operator interface 240 a user may select a burner (or oven) to configure a customized duty cycle. Once a specified burner 106 is selected a user may then select and specify a total cycle time, an "on" time period, an "off" time period" within the cycle. In this embodiment the gas valve 360 and thus the burner 106 operates at minimum flow during the "on" portion of the cycle. The user may select each of the total cycle time, the "on" time period and the "off" time period" within the cycle using operator interface 240 and then save that selection by assigning a name thereto for retrieval and further use. Shorter "on" periods in the duty cycle can thus be selected where the cookware and food necessitate a lower temperature or burner 106 power level, while longer "on" times can be configured as required for a particular cooking application. Processor 202 stores the burner 106 customized duty cycle in memory 204 for future use. Furthermore, a plurality of customized duty cycles may be configured and saved for each burner 106 of appliance 100.

In accordance with some aspects of the invention system 10 also permits a user to select, modify and save a duty cycle for a specific burner 106 and/or gas valve 360 by selecting and specifying a total cycle time, an "on" time period, an "off" time period" within the cycle and an "on" cycle burner power or temperature level. For example, once the cycle length and "on" and "off" times are selected, the user can then select a burner power level by percentage of gas 1 flow. In some exemplary but non-limiting examples a specified burner could be assigned a 25%, 50%, or 75% power level. Once all variables are selected and configured for a given duty cycle, processor 202 stores the burner 106 customized duty cycle in memory 204 for future use.

Additionally, and in accordance with another embodiment of the invention, the burner 106 power level during the duty cycle may be selected by operation of the control knob 110 assigned to the burner. Again, using the operator interface 240 a user can depress a button or icon to set the burner power level, whereby the control knob 110 assigned to that burner 106 may then be turned to provide an encoder 342 output 344 as an input 220 to processor 202 representative of burner power. In this fashion, a user may actually use the burner 106 while selecting the power level during the duty cycle, thus enabling a user to select an infinitely variable number of power settings. In the embodiments of the invention where two burner 106 power levels are selectable, the operator interface 240 may prompt the user to select a first power level with knob 110 and then a second power level with knob 110. Once all variables are selected and configured for this duty cycle, processor 202 stores the burner 106 customized duty cycle in memory 204 for future use.

In yet further aspects and embodiments of the invention system 10 permits a user to cycle a burner 106 on and off at its minimum flow rate based upon temperature feedback of that burner 106 for the purpose of maintaining a highly accurate low cook or simmer temperature. In these embodiments the operator interface 240 can be used to set a small temperature range around which the burner 106 operates and processor 202 monitors a temperature sensor 380 placed proximate that burner 106. For example, where a particular cooking application calls for a 165 F temperature, a user may select an upper range of 167 F and a lower range of 163 F for burner 106 operation. Burner 106 then operates at its minimum heat setting until temperature sensor 380 detects the upper temperature limit of 167 F. Processor 202 accepts an input 220 from sensor 380 indicative of the upper temperature limit and shuts burner 106 off until the lower temperature limit, 163 F is reached whereupon the burner 106 is reignited at minimum power and the cycle repeats. This feature of the invention permits a user to maintain a tightly controlled temperature range using a conventional oven 100.

In some additional aspects and embodiments, a user can utilize the control knob 110 assigned to a particular burner 106 to set a duty cycle percentage, thereby selecting the "on" and "off" times. Again the operator interface 240 is utilized to select the burner 106 being configured. In this embodiment where the control knob 110 is being used to set the duty cycle time processor 110 prohibits the valve 360 that is assigned to that knob 110 from operating during the configuration procedure. The user simply selects a duty cycle period and a duty cycle percentage by turning control knob 110, and then stores the duty cycle for further use. For example, if the duty cycle period is 30 seconds and the duty cycle percentage is 63% the burner 106 will cycle on for 19 seconds and off for 11 seconds. This feature is particularly advantageous when using very low cooking temperatures.

As will be apparent to one of ordinary skill in the art the various embodiments and methods discussed herein above with respect to cooktop burners 106 may also be employed to control oven 100 burners 106 without departing from the scope of the invention.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A system for controlling the flow of a gas from a gas supply to a burner of an appliance comprising:

a processor and concomitant data memory, the processor having a plurality of inputs and outputs for receiving and providing electrical signals to a plurality of electrical components of the appliance;

a gas valve in fluid communication with the burner having an actuator that accepts an output from the processor representative of valve position to control the supply of gas to the burner;

a control knob assigned to the burner having an output representative of a heat level of the burner operatively coupled to an input of the processor;

a user interface operatively coupled to the processor; and whereby the gas valve is cycled on and off by providing an output from the processor to the valve actuator determined by a configurable duty cycle, wherein the configurable duty cycle includes a configurable cycle period, a configurable ON time during the cycle period, and a plurality of configurable burner power levels, wherein each of the configurable cycle period, the configurable ON time during the cycle period, and the plurality of configurable burner power levels are provided to the processor by operation of the control knob, and wherein each of the plurality of configurable burner power levels are further selected using the user interface.

2. The system of claim 1, wherein each of the plurality of configurable burner power levels is provided to the processor by operation of the control knob while gas is being supplied to the burner and the burner is ignited.

3. The system of claim 1, wherein the plurality of burner power levels are representative of percentages of gas flow to the burner.

4. The system of claim 1, wherein the ON time is represented using a duty cycle percentage.

5. A system for controlling the flow of a gas from a gas supply to a burner of an appliance comprising:

a processor and concomitant data memory, the processor having a plurality of inputs and outputs for receiving and providing electrical signals to a plurality of electrical components of the appliance;

a gas valve in fluid communication with the burner having an actuator that accepts an output from the processor representative of valve position to control the supply of gas to the burner;

at least one control knob assigned to the burner having an output representative of a power level of the burner operatively coupled to an input of the processor; and whereby the gas valve is cycled between a plurality of valve positions by providing an output from the processor to the valve actuator determined by a configurable duty cycle, wherein the configurable duty cycle includes a configurable cycle period, a configurable ON time during the cycle period, and a plurality of configurable burner power levels.

6. The system of claim 5, further comprising a user interface operatively coupled to the processor, wherein the plurality of configurable burner power levels are selected using the user interface.

7. The system of claim 5, wherein the configurable cycle period, the configurable ON time during the cycle period, and the plurality of configurable burner power levels are provided to the processor by operation of the at least one control knob.

8. The system of claim 5, wherein the plurality of configurable burner power levels are provided to the processor by operation of the at least one control knob.

9. The system of claim 5, further comprising a user interface operatively coupled to the processor, wherein the configurable cycle period, the configurable ON time during the cycle period, and the plurality of configurable burner power levels are selected using the user interface.

10. The system of claim 5, wherein each of the plurality of burner power levels is representative of a percentage of gas flow to the burner.

* * * * *